US011480390B2

(12) United States Patent
Yoshimoto et al.

(10) Patent No.: US 11,480,390 B2
(45) Date of Patent: Oct. 25, 2022

(54) FREEZE-DRYING DEVICE AND FREEZE-DRYING METHOD

(71) Applicant: ULVAC, INC., Chigasaki (JP)

(72) Inventors: Tsuyoshi Yoshimoto, Chigasaki (JP); Yoichi Ohinata, Chigasaki (JP); Tomomitsu Ozeki, Chigasaki (JP)

(73) Assignee: ULVAC, INC., Chigasaki (JP)

( * ) Notice: Subject to any disclaimer, the term of this patent is extended or adjusted under 35 U.S.C. 154(b) by 0 days.

(21) Appl. No.: 17/683,028

(22) Filed: Feb. 28, 2022

(65) Prior Publication Data

US 2022/0260313 A1 Aug. 18, 2022

Related U.S. Application Data

(63) Continuation of application No. 17/448,446, filed on Sep. 22, 2021, now Pat. No. 11,320,200, which is a (Continued)

(51) Int. Cl.
*F26B 5/06* (2006.01)

(52) U.S. Cl.
CPC ..... *F26B 5/06* (2013.01)

(58) Field of Classification Search
CPC .. F26B 5/00; F26B 5/06; F26B 11/049; F26B 11/0445; F26B 11/182
See application file for complete search history.

(56) References Cited

U.S. PATENT DOCUMENTS 3,146,077 A 8/1964 Fuentevilla
4,016,657 A 4/1977 Passey
(Continued)

FOREIGN PATENT DOCUMENTS

CN 106679338 A 5/2017
EP 2320185 B1 8/2016
(Continued)

OTHER PUBLICATIONS

U.S. Appl. No. 17/448,446, Notice of Allowance dated Jan. 4, 2022.
(Continued)

*Primary Examiner* — Stephen M Gravini
(74) *Attorney, Agent, or Firm* — Schwegman Lundberg & Woessner, P.A.

(57) ABSTRACT

A freeze-drying device includes a controller configured to control depressurization of containers filled with a liquid including a raw material and a medium to freeze the liquid from a liquid surface. The freeze-drying device also includes a gas capture pump configured to exhaust a freeze-drying chamber accommodating the containers, and a positive-displacement pump configured to discharge gas from a space accommodating the gas capture pump. The controller executes an exhaust mitigation process that performs the depressurization at an exhaust capability that is less than a rated exhaust capability of the freeze-drying device. The controller uses a partial pressure value of the medium to determine when the exhaust mitigation process ends. The controller maintains an exhaust speed of the gas capture pump and decreases an exhaust speed of the positive-displacement pump in the exhaust mitigation process.

8 Claims, 2 Drawing Sheets

Related U.S. Application Data continuation of application No. PCT/JP2021/005602, filed on Feb. 16, 2021.

(56) References Cited

U.S. PATENT DOCUMENTS

| | | | | |
|---|---|---|---|---|
| 5,743,023 | A | 4/1998 | Fay et al. | |
| 6,233,841 | B1 | 5/2001 | Beach | |
| 6,935,049 | B2 | 8/2005 | Alstat | |
| 7,347,004 | B1 | 3/2008 | Halvorsen | |
| 8,528,225 | B2 | 9/2013 | Weisselberg | |
| 8,875,413 | B2 * | 11/2014 | Ling | F26B 5/06 34/298 |
| 8,978,268 | B2 * | 3/2015 | Itou | F26B 5/065 34/291 |
| 9,052,138 | B2 | 6/2015 | Demarco et al. | |
| 9,435,586 | B2 * | 9/2016 | Ling | F26B 5/06 |
| 10,627,162 | B2 | 4/2020 | Delaveau | |
| 11,047,620 | B2 | 6/2021 | Beutler et al. | |
| 11,054,185 | B1 | 7/2021 | Trappler et al. | |
| 11,090,711 | B2 | 8/2021 | Golfetto | |
| 11,121,360 | B2 | 9/2021 | Zhamu et al. | |
| 11,181,320 | B2 | 11/2021 | Dern | |
| 11,320,200 | B1 * | 5/2022 | Yoshimoto | F26B 5/06 |
| 2011/0192047 | A1 | 8/2011 | Itou et al. | |
| 2014/0041250 | A1 | 2/2014 | Ling | |
| 2014/0202025 | A1 | 7/2014 | Ling | |
| 2020/0248963 | A1 | 8/2020 | Beutler et al. | |

FOREIGN PATENT DOCUMENTS

| | | | | |
|---|---|---|---|---|
| EP | 3117165 | A1 | 1/2017 | |
| EP | 2883012 | B1 * | 1/2018 | F26B 5/06 |
| JP | 5386487 | B2 | 10/2013 | |
| JP | 2017020738 | A | 1/2017 | |
| JP | 2017508126 | A | 3/2017 | |
| JP | 2019184152 | A | 10/2019 | |
| JP | 2020517884 | A | 6/2020 | |
| JP | 2020100479 | A | 7/2020 | |
| JP | 2020159629 | A | 10/2020 | |
| KR | 101280159 | B1 | 6/2013 | |
| KR | 20170008158 | A | 1/2017 | |
| WO | WO-2010005021 | A1 | 1/2010 | |
| WO | WO-2014028119 | A1 * | 2/2014 | F26B 5/06 |
| WO | WO-2015138005 | A1 | 9/2015 | |
| WO | WO-2018013254 | A1 | 1/2018 | |
| WO | WO-2020161863 | A1 | 8/2020 | |

OTHER PUBLICATIONS

International Application Serial No. PCT/JP2021/005602, International Search Report dated May 11, 2021, (dated May 11, 2021), 3 pgs.

International Application Serial No. PCT/JP2021/005602, Written Opinion dated May 11, 2021, w/ English Translation & English Claims, (May 11, 2021), 13 pgs.

Allmendinger, Andrea, et al., "Controlling ice nucleation during lyophilization: Process Optimization of vacuum-induced surface freezing", Processes 8.10, (2020), 1263.

Arsiccio, Andrea, et al., "Vacuum Induced Surface Freezing as an effective method for improved inter- and intra-vial product homogeneity", European Journal of Pharmaceutics and Biopharmaceutics 128, (2018), pp. 210-219.

Okawa, Seiji, et al., "Supercooling Phenomenon of Water", Netsu Bussei 8 [4], (1994), pp. 256-262.

International Application Serial No. PCT/JP2021/005602, International Search Report dated May 11, 2021, w/ English Translation (May 11, 2021), 9 pgs.

* cited by examiner

FREEZE-DRYING DEVICE AND FREEZE-DRYING METHOD

CLAIM OF PRIORITY

This application is a continuation of and claims the benefit of priority under 35 U.S.C. § 120 to U.S. patent application Ser. No. 17/448,446, filed on Sep. 22, 2021, which is a continuation of and claims the benefit of priority under 35 U.S.C. § 120 to International Application No. PCT/JP2021/005602, filed on Feb. 16, 2021, each of which is incorporated by reference herein in its entirety.

BACKGROUND

1. Field of the Invention

The following description relates to a freeze-drying device and a freeze-drying method that freeze-dry a liquid using vacuum-induced surface freezing.

2. Description of Related Art

A device that freeze-dries a liquid dispensed in a container, such as a vial, can remove moisture or the like without adding excessive heat. Thus, the device is widely used to manufacture liquid medicinal products and liquid biologics to hinder biological characteristic degradation. The liquid used for freeze drying is a solution obtained by mixing raw materials and a medium. A freeze-drying method that uses a freeze-drying device places a container containing a dispensed liquid on a cooling shelf in a freeze-drying chamber in a half-plugged state, and freezes the liquid in preliminary manner, subsequently removes a medium in a frozen material by sublimating the medium without going through a liquid phase again, and then completes the process by plugging the container in the half-plugged state (refer to Japanese Laid-Open Patent Publication Nos. 2019-184152 and 2020-100479).

Typical liquid freezing is performed by exposing a container arranged in a freeze-drying device to a temperature environment causing a supercooled state under atmospheric pressure or by exposing the container to a temperature environment causing the supercooled state under a pressure lower than the atmospheric pressure by about two to four percent. The heat of a liquid is removed from the container, which is a contact surface, and the entire liquid is finally frozen by the growth of an ice nucleus. At this time, a cooling unit in the freeze-drying device is a shelf including a supporting surface of the container. Thus, the ice nucleus is formed at a position closer to the bottom side in the container than the center, that is, in a lower layer part of the liquid. This results in crystal growth and eventually freezes the entire liquid. Here, the ice nucleus is a phenomenon in which a nucleus of a solid phase is generated in a liquid phase. Nucleation is a thermodynamic phenomenon irrespective of whether the nucleation is heterogeneous nucleation or homogeneous nucleation. Thus, an event in which the ice nucleus grows as a crystal is observed as a stochastic phenomenon. In other words, the liquid in each container arranged in the freeze-drying device freezes based on a freezing stochasticity per unit time, which is a stochasticity corresponding to a temperature environment. Then, if an experimentally-obtained aging time elapses, the freeze-drying device determines that all liquids are frozen, and proceeds to a depressurization process, i.e., a drying process after freezing, for example. In other words, by providing the aging time, the freeze-drying device copes with the randomness of freezing stochasticity to advance the process after the liquids are all frozen.

The above-described freezing from a lower layer of a liquid and the randomness of a freezing period cause inconvenience from the aspect of production efficiency and quality control for each container. Thus, methods solving such problem has been proposed. One proposed method uses ice fog or the like. This method releases ice particles from frost formed in a condenser or the like, and a phase change is triggered by contact between the released particles having a solid phase surface, and a liquid surface portion (refer to Japanese Laid-Open Patent Publication Nos. 2020-517884 and 2017-508126). Then, the liquids in every container is frozen by causing a crystal growth downward from liquid surfaces in substantially the same period. Nevertheless, a technical issue lies in bringing particles into contact with the liquid in every container, and it is obvious that particles become mixed in the products. Thus, there is a possibility of contamination of the liquid. Thus, there is a shortcoming in that the ice fog generation unit or the like is complicated and that work for ensuring cleanness of the generation unit and the like will greatly decrease production efficiency. As another method, vacuum-induced surface freezing (VISF) causes ice nucleation from a liquid surface in the process of decreasing pressure from atmospheric pressure without using the above-described solid phase particles. This freezing method is described in 1) European Journal of Pharmaceutics and Biopharmaceutics 128 (2018)210-219, and 2) Netsu Bussei (Japan Journal of Thermophysical Properties) 8 [4] (1994) 256/262 Topic: Snow/Ice and Utilization Technology "Supercooling Phenomenon of Water", 3) Processes 2020, 8, 1263, Controlling Ice Nucleation during Lyophilization: Process Optimization of Vacuum-induced Surface Freezing. This freezing method solves the above-described inconvenience. Nevertheless, issues remain from the aspect of quality. For example, a freezing period becomes random depending on a transient response state of a pressure decrease, or crude density, structural disorder, a structural boundary, or the like is generated due to a bumping phenomenon, without generating a frozen liquid having a homogeneous distribution. In addition, the structural boundary is generated when a dried product is a non-defective product as an external form, and includes no destruction, and a crystal growth speed of a medium significantly changes. The structural boundary is considered to be triggered by a change in crystal state of the medium being transformed into raw materials. As an example, the structural boundary is confirmed by visually checking the dried product. Specifically, a difference in surface roughness can be confirmed at the structural boundary.

SUMMARY

When a freeze-drying device performs vacuum-induced surface freezing, which is one freeze-drying methods, a room-temperature liquid is cooled in a freeze-drying chamber, which is separated from atmosphere, to a predetermined exhaust process initiation temperature. As the temperature drops to the exhaust process initiation temperature, the solubility of gas with respect to a medium rises, and the number of molecule of gas dissolved in the liquid increases. After the temperature of the liquid decreases to the exhaust process initiation temperature, the pressure under the atmosphere of the liquid is decreased. At this time, the present inventors have perceived that a bumping phenomenon occurs in the liquid. The bumping phenomenon occurring in the liquid not only scatters the liquid and freezes and dries the scattered liquid but also hinders stable crystal growth. In some cases, the frozen liquid may be destructed or disintegrated. In other words, when adding a pressure variation causing the bumping phenomenon to a medium during the generation of an ice nucleus and the growth of the ice nucleus bringing a frozen material into a heterogeneous state will result in variations in the shape and characteristics of a dried material, deteriorate the quality of the final product, or decrease yield.

One aspect of the present disclosure is a freeze-drying device including a controller configured to control depressurization of containers filled with a liquid including a raw material and a medium to freeze the liquid from a liquid surface. The controller executes an exhaust mitigation process that performs the depressurization at an exhaust capability that is less than a rated exhaust capability of the freeze-drying device, and the controller uses a partial pressure value of the medium to determine when the exhaust mitigation process ends.

A further aspect of the present disclosure is a freeze-drying method including depressurizing containers filled with a liquid including a raw material and a medium using a freeze-drying device to freeze the liquid from a liquid surface. The depressurizing includes executing an exhaust mitigation process that performs the depressurizing at an exhaust capability that is less than a rated exhaust capability of the freeze-drying device, and using a partial pressure value of the medium to determine w % ben the exhaust mitigation process ends.

According to a freeze-drying device and a freeze-drying method according to the present disclosure, variations are minimized in the shape and characteristics of a dried material, and production efficiency is improved.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
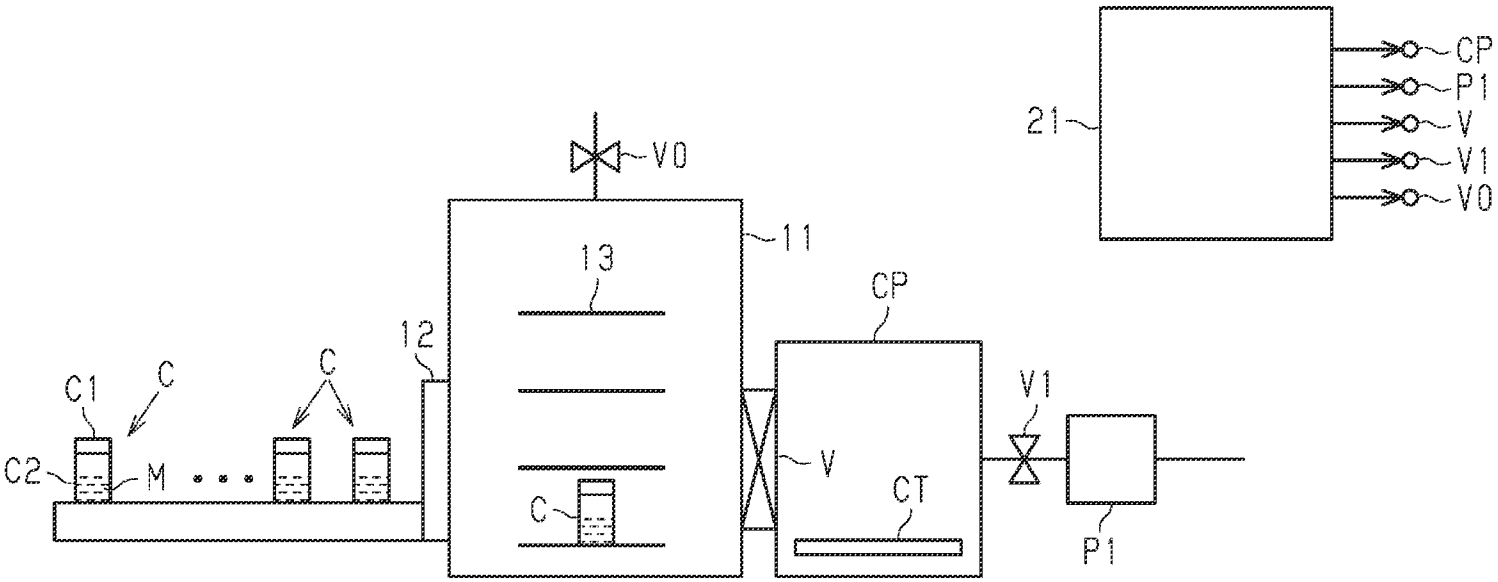
FIG. 1 is a diagram illustrating the configuration of one embodiment of a freeze-drying device.

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

One embodiment of a freeze-drying device and a freeze-drying method will now be described with reference to FIGS. 1 and 2.

A freeze-drying method is a process for obtaining a dried product by freezing a medium included in a liquid and sublimating the frozen medium. Components included in the liquid include raw materials and a medium. The process for obtaining a dried product changes raw materials into a porous state. The raw materials include solute, and may include dispersoid, an additive, or the like. The properties of the raw materials are not limited as long as the raw materials are arranged in an isotropic manner in the medium. The medium includes a solvent, of which the main component is water, or may be a medium including a disperse medium, an additive, or the like. The raw materials include medicinal products, food products, cosmetic products, inorganic substance nanoparticle, and the like. The liquid may be a liquid obtained by dissolving powder of raw materials in a solvent or a liquid obtained by dissolving powder of raw materials in a disperse medium. The additive may be various stabilization agents, a pH adjuster such as buffer solution, or a coagulant agent. To prevent tissues from being destroyed by the expansion caused when water freezes, the medium may be a mixed solvent of water and polyethylene glycol, or polyethylene glycol or butanol replaced from water. An example of density of the medium included in the liquid is 80 mass % or more of the entire liquid.

The freeze-drying device uses vacuum-induced surface freezing as a freezing method used in a freeze-drying method. The freezing method will be now be described briefly. First of all, as preliminary cooling, the freeze-drying device removes the heat of a room-temperature liquid serving as a high heat source using a shelf supporting a container filled with a liquid serves as a low heat source. In addition, a target temperature of preliminary cooling is near a lower limit of a temperature in which phase transition from a liquid phase to a solid phase does not occur under an environment near atmospheric pressure, and a temperature in which phase transition from a liquid phase to a solid phase does not occur until an ice nucleation process. After the preliminary cooling, the freeze-drying device forms a depressurized environment by decreasing an ambient environmental pressure of the liquid from the atmospheric pressure. This selectively cools a liquid surface upper layer part including a gas-liquid interface of the liquid. Consequently, the freeze-drying device generates an ice nucleus on the liquid surface, and crystal grows downward from the liquid surface upper layer part.

The depressurized environment formed by the freeze-drying device in vacuum-induced surface freezing applies depressurization energy to the liquid. To maintain equilibrium under the depressurized environment, gas and the medium dissolved in the liquid are released from the liquid surface in the form of a gas phase. In typical vacuum-induced surface freezing, the application of depressurization energy supplied by the freeze-drying device to the liquid, the release of dissolved gas from the liquid surface, and the acceleration of phase transition on the liquid surface are performed in parallel. The depressurization energy draws heat energy from the liquid surface upper layer part of the liquid and discharges the heat energy to the outside of the system. The freeze-drying device that performs vacuum-induced surface freezing removes heat of the liquid and sends the heat to the shelf serving as a low heat source through contact thermal conductance via the container. The freeze-drying device also removes heat from the liquid surface.

The freeze drying method is a process for freezing and then drying the entire region of the liquid. If a crystal is dissolved during a crystal growth in the liquid freezing process, a product becomes heterogeneous. The dissolving of crystal during crystal growth indicates that, for example, the increase in heat flux that is attributed to solidification latent heat caused by the crystal growth cannot be sufficiently released to the ambient environment. In this manner, a processing condition after an ice nucleus is generated using the vacuum-induced surface freezing becomes important from the aspect of the shape and characteristics of a dried material, which is a product.

The freeze-drying device grows crystals by generating an ice nucleus in the liquid surface upper layer part of the liquid using the above-described method. In a case where the medium is water, an ice nucleation stochasticity per unit time under atmospheric pressure, that is, an example of a stochasticity at which an ice nucleus growable as crystal is generated rises from 0° C. to −39° C., and becomes substantially 1 at −40° C. or less irrespective of unit time. As another example of an ice nucleation stochasticity, according to FIG. 12 of Netsu Bussei (Japan Journal of Thermophysical Properties) 8 [4] (1994) 256/262 Topic: Snow/Ice and Utilization Technology "Supercooling Phenomenon of Water", in a case where a unit time is set to 300 sec, an ice nucleation stochasticity becomes substantially 1 at a predetermined value around −20° C. or less. In the vacuum-induced surface freezing, heat is drawn from the liquid surface upper layer part of the liquid by decreasing the ambient environmental pressure of the liquid in a supercooled state. In other words, the vacuum-induced surface freezing accelerates phase transition from a liquid phase to a solid phase, and accelerates a rise in ice nucleation stochasticity, by selectively drawing heat from the liquid surface upper layer part of the liquid. By decreasing the ambient environmental pressure to a region in which a phase of the medium becomes a gas phase, the vacuum-induced surface freezing further cools the liquid surface upper layer part of the liquid and accelerates nucleation, sufficiently raises a generation stochasticity of an ice nucleus perf unit time, generates crystals, and grows the crystals.

The ice nucleation is an event occurring at a predetermined stochasticity by a temperature of the liquid becoming an equilibrium freezing point or less. In addition, at an initial stage of an ice nucleus that is a cluster of several tens of aggregated molecules, which is referred to as an embryo, the ice nucleus can melt and change to a liquid phase without growing as a solid phase after the generation of the cluster. The generation and meltdown of the cluster are equilibrium events for keeping the liquid phase in a supercooled condition. The equilibrium is lost at a stochasticity such as that described in Netsu Bussei (Japan Journal of Thermophysical Properties) 8 [4] (1994) 256/262 Topic: Snow/Ice and Utilization Technology "Supercooling Phenomenon of Water", and an ice nucleus is generated afterward. In other words, nucleation in a liquid is a thermodynamic physical phenomenon, and a difference in stochasticity at which an ice nucleus is generated is checked in, for example, a time unit of a period of the supercooled state, which is a transient phenomenon. The supercooled state corresponds to a state in which a form of a liquid is a liquid phase among three forms at a temperature less than or equal to an equilibrium freezing point. The liquid in the supercooled state transitions to a solid phase at a predetermined stochasticity during aging. This is implemented by the generation and the growth of an ice nucleus. The ice nucleus is a nucleus growing as crystal after the generation, and does not include a nucleus that melts and disappears without growing as crystal after the generation. In addition, the history of crystal growth is transferred to a steric structure of raw materials in the container, which is a final product that has been dried. Thus, maintaining the quality of crystal in this half-finished product, that is, in a liquid in which three forms of the medium include a liquid phase and a solid phase, is a key factor for bringing the steric structure of raw materials into a desired state.

Liquid freezing that uses vacuum-induced surface freezing differs in direction of heat flux from heat removal of a liquid through typical shelf cooling that dominantly uses convection current to draw all of the heat amount from the liquid. Since heat removal is performed so that an ice nucleus of a medium is generated at a gas-liquid interface of the liquid, crystals grow toward the lower side of the gas-liquid interface. When the liquid freezing method uses shelf cooling, crystal grows from a container bottom surface or a container side surface, that is, from a solid-liquid interface of the liquid. Freezing of a liquid refers to, for example, freezing of only a medium. The freezing is completed by crystal growth of an ice nucleus so that three forms of the entire medium become a solid phase, that is, three forms of the entire liquid become a solid phase. Raw materials dissolved in the medium and dissolved gas, for example, generally move to a grain boundary of crystal grains and nucleated as the medium freezes, that is, as crystals grow in the medium. Raw materials dissolved in the medium change to a eutectic state or a porous solid state such as a glassy material, for example, near the grain boundary of the medium crystal, for example, at the stage where three forms of the entire medium change to the solid phase. The dissolved gas desorbs as gas from the liquid changes to the solid phase in accordance with a diffusion coefficient of dissolved gas. If nucleation predominates over diffusion of dissolved gas, a bubble nucleus is generated in the liquid finally changing to the solid phase. The bubble nucleus grows and destroys the liquid changing to the solid phase. In any case, the medium transitions to a gas phase and, consequently, all of the medium is discharged out of the system, and raw materials reflecting a steric structure at the stage where all liquids turn to the solid phase remain in the container. A solid material of raw materials having such a steric structure is the product produced by the freeze-drying device.

If the liquid transitions to the initial stage of freezing described above, that is, a state in which the generation of an ice nucleus predominates over the disappearance of an ice nucleus, latent heat resulting from crystal growth is added to a heat amount of the liquid. The temperature of the liquid thereby rises promptly to a triple point in a phase diagram of a medium. If the liquid includes pure water, the temperature of the liquid rises promptly to 0° C., which is an equilibrium freezing point of pure water. Further, since an equilibrium freezing point of a liquid decreases due to the included raw materials or the like, when the main component of the medium is water, the temperature of the liquid rises promptly to any value less than or equal to 0° C. In the initial stage of freezing, three forms of a liquid inside the container become two-form coexistence with the solid phase and the liquid phase, that is, two-phase coexistence. An ambient environment of the container becomes a gas phase condition from the aspect of three forms of the medium. In other words, even in a short time, the medium is caused to change in such a manner that three forms enter an equilibrium state not only at a gas-liquid interface of the liquid but also inside of the liquid. In other words, the medium turns to a gas phase from the solid phase or the liquid phase. To avoid such a situation, before the medium in the liquid turns to a gas phase and causes a bubble or bumping phenomenon, the above-described freeze-drying device promptly raises the pressure in the ambient environment of the container to a high pressure that is greater than or equal to a triple point such as an atmospheric pressure. In addition, in a case where a pressure decreases to a solubility at which gas cannot be dissolved, dissolved gas is prompted to generate a bubble nucleus and cause a growth thereof, which is a phenomenon similar to turning to the above-described gas phase. This generates a bumping phenomenon in the liquid. A volume of dissolved gas contained in the liquid can be obtained by a known method. For example, a volume of dissolved gas is obtained as a volume less than or equal to a volume indicated by the temperature of the liquid, a lower limit pressure, and a solubility curve. The volume of dissolved gas contained in the liquid is desirably set to, for example, one half or less of a volume allowed by the solubility curve. This is because the conductance of the medium that corresponds to a resistance when dissolved gas moves to the liquid surface is high and a decrease speed of the liquid phase is high in the initial stage of freezing, that is, a crystal growth speed is fast.

In addition, when a pressure in the ambient environment of the container is promptly risen to avoid a bumping phenomenon after the initial stage of freezing, the entire liquid need not be frozen, and three forms of the liquid may include the solid phase and the liquid phase. At this time, a condition of ensuring a longer time for a crystal growth because of a state of a liquid in which a ratio of a liquid phase with respect to a solid phase is sufficiently high, that is, a low supercooling degree of a liquid is preferable from the viewpoint of coarsening of crystal grains. Coarsened crystal grains increase the porosity in the product produced by the freeze-drying device. Further, the number of opened pores become greater than the number of closed pores. For example, each pore is an open space that is a vestige of sublimation of crystal grains and surrounded by raw materials. The space of the pores are likely to be connected by the coarsening of crystal grains. When the connected space becomes coarse, a release path of gas generated by the sublimation of crystal grains expands. This shortens the time required for a drying process after vacuum-induced surface freezing.

In a case where coarsened crystal grains are required in the freezing of the liquid, a lower limit value of an exhaust process initiation temperature in the liquid is preferably lower than an equilibrium freezing point by approximately 5° C., and an upper limit value of an exhaust process initiation temperature in the liquid is preferably higher than the equilibrium freezing point by approximately 1° C. This is to lower the supercooling degree and reduce the heat amount used as solidification heat generated by a crystal growth after ice nucleation. A lower limit value of the temperature of a shelf on which the container is placed is preferably lower than an equilibrium freezing point by approximately 10° C. taking into consideration thermal resistance, and an upper limit value of a temperature of the shelf on which the container is placed is preferably lower than the equilibrium freezing point by approximately PC. This increases production efficiency taking into consideration the time constant of a heat circuit. As a matter of course, if production efficiency is ignored, the temperature of the shelf may be set to substantially the same temperature as the exhaust process initiation temperature of the liquid. Determination as to whether a liquid temperature reaches an equilibrium state can be performed by, for example, determining whether a time corresponding to 95% of a time constant of a heat circuit has elapsed. In addition, in a case where a fine porous member is the product produced by the freeze-drying device, it is preferable that crystal grains are not coarsened and that the above-described shelf temperature or the like be set to a lower temperature.

In addition, by generating ice nucleuses with the liquids in the containers at substantially the same time, similar crystal growth in the containers and, subsequently, similar drying can be advanced. This reduces variation in the quality between the containers. Thus, it is preferable that an ice nucleus not be generated at the initial stage of vacuum-induced surface freezing, that is, when depressurization is started from the atmospheric pressure or in the stage in which the pressure of the container is decreased during an exhaust mitigation process. It is preferable that an ice nucleus be generated at a time point immediately before the pressure promptly rises in a subsequent processing stage, that is, in a stage immediately before a pressure is recovered to a pressure greater than or equal to a triple point. In other words, it is preferable that the generation stochasticity of an ice nucleus be kept substantially constant until immediately before pressure recovery and that the generation stochasticity of an ice nucleus be increased immediately before pressure recovery.

As described above, a freeze-drying device that uses vacuum-induced surface freezing as a freezing method first decreases the temperature of the liquid from a room temperature to a predetermined temperature. Then, a depressurized environment is formed by decreasing an ambient environmental pressure of the liquid from an atmospheric pressure. Thus, the freeze-drying device selectively cools the liquid surface upper layer part including the liquid surface that is the gas-liquid interface of the liquid. Further, the freeze-drying device generates an ice nucleus on the liquid surface and promptly raises the pressure in the ambient environment of the container to a high pressure that is greater than or equal to a triple point such as an atmospheric pressure before dissolved gas in the liquid, the medium, and the like turn into the gas phase and a bubble or bumping phenomenon, which is a phenomenon attributed to selective cooling, occurs to avoid such phenomena. In addition, although Processes 2020, 8, 1263, Controlling Ice Nucleation during Lyophilization: Process Optimization of Vacuum-Induced Surface Freezing describes various freezing methods for avoiding the bumping phenomenon, these methods are not sufficient. The inventors have confirmed a bubble or bumping phenomenon in some liquids. The inventors have also found that variations in the shape and characteristics of a dried material have not been sufficiently reduced.

Moreover, gas dissolved in the liquid, that is, dissolved gas causes a bubble or bumping phenomenon, and it is necessary to further eliminate this prior to freezing for the steric structure of raw materials to be in the desired condition. To eliminate dissolved gas in a process before freezing, the use of a partial pressure value of the medium such as a water vapor partial pressure value is effective for determining to change transition of a pressure value. In other words, by using a method of selectively cooling the liquid surface upper layer part in the process of removing dissolved gas, the quality of a product can be further improved. In the description hereafter, the process for removing dissolved gas, that is, the process for selectively cooling the liquid surface upper layer part will be described as an exhaust mitigation process.

Freeze-Drying Device

Next, a configuration of a freeze-drying device that executes the exhaust mitigation process will be described with reference to FIG. 1.

Figure 2:
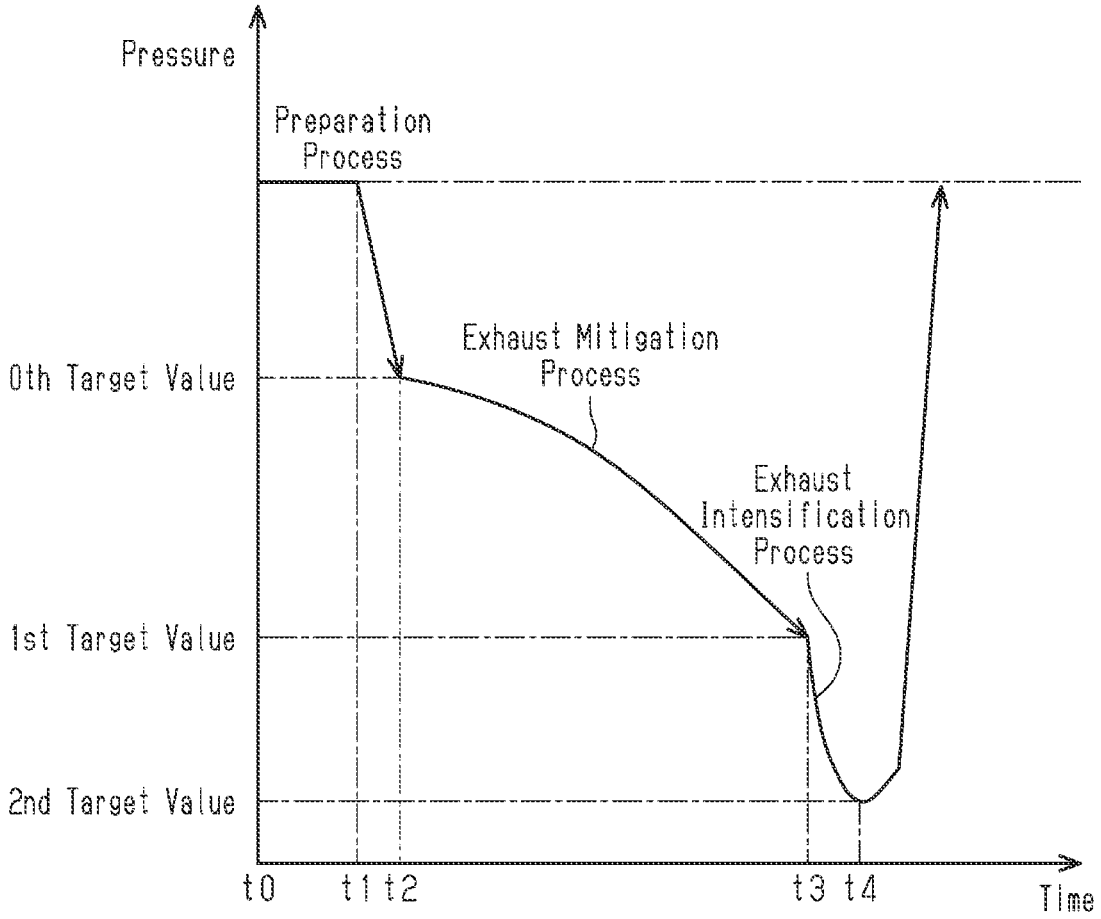
FIG. 2 is a graph illustrating the transition of pressure in one embodiment of a freeze-drying method.

As illustrated in FIG. 1, the freeze-drying device includes a freeze-drying chamber 11, a main valve V, a cryo-chamber CP, a control valve V1, a vacuum pump P1, and a controller 21. The freeze-drying chamber 11 and the cryo-chamber CP are connected by the main valve V. The cryo-chamber CP and the vacuum pump P1 are connected by the control valve V1

The freeze-drying chamber 11 includes a loading door 12 and a cooling stage 13. The loading door 12 opens and closes the freeze-drying chamber 11. The loading door 12 can hermetically seal the freeze-drying chamber 11 by closing the freeze-drying chamber 11. The loading door 12 opens the freeze-drying chamber 11 to allow a conveying mechanism formed by a conveyor and rails to perform locating and unloading. The conveying mechanism conveys a container C from the outside of the freeze-drying device into the freeze-drying chamber 11. The external environment of the freeze-drying device is managed in accordance with the requirements of the container C. Examples of the external environment are managed in compliance with JISB9920-1 (clean room and related control environment—First Section: classification of air cleanliness by number of floating particles density, cleanliness class (N)5 described in Table 1 described in 4.3 cleanliness class number, or JISB9922 (environment condition of clean bench)), or the like. In a specific example, the temperature, pressure, and relative humidity of the external environment are 20° C., 101.3 kPa, and 50%. Such an environment stabilizes the initial conditions by limiting the entrance of foreign substance, which may act in the same manner as an ice nucleus, into the liquid surface.

The freeze-drying chamber 11 includes a vacuum gauge. The cryo-chamber CP may include a vacuum gauge. The vacuum gauge is, for example, a diaphragm gauge, a pirani gauge, a hot cathode ionization gauge, quadrupole mass analyzer, a vacuum gauge that measures pressure in a contactless manner using a spectroscopic method, or a combination of these devices. A vacuum gauge used for vacuum-induced surface freezing is preferably a vacuum gauge that can measure not only a total pressure value but also a partial pressure value of water that is condensable gas, or a vacuum measuring system that uses a plurality of vacuum gauges. Such a vacuum gauge can control a liquid surface temperature of a liquid M in a container main body C2 more accurately.

The container C includes a lid member C1 and the container main body C2. The container C may be a vial, a syringe, or an ampule. The container C is arranged outside the freeze-drying device, and the liquid M is dispensed in the container main body C2. The dispensing of the liquid M may be performed using a dispenser or a pipette. In the dispensed liquid M, gas such as air is dissolved in the liquid M at a solubility corresponding to the external environment. Gas dissolved in the liquid M includes nitrogen and oxygen. In a case where a medium of the liquid M is water at 20° C. the air dissolved in the liquid M of 1 $cm^3$ is considered to be about 0.019 $cm^3$ (0° C., 1 atm) in volume, which increases to approximately 0.029 $cm^3$ (0° C., 1 atm) at 0° C.

The container main body C2 of the dispensed container C is half-plugged by the lid member C1. The half-plugged container main body C2 maintains a state in which an internal environment of the container main body C2 is connected with the outside. The dispensed container C is conveyed in the half-plugged state into the freeze-drying chamber 11 from the loading door 12. When the container C is located in the external environment, the internal environment of the container main body C2 stabilizes when becoming the same as the external environment. When the container C is located in the freeze-drying chamber 11, the internal environment of the container main body C2 stabilizes when becoming the same as the internal environment of the freeze-drying chamber 11. If there is a difference between the internal environment of the container main body C2 and the internal environment of the freeze-drying chamber 11, the two stabilize after a transient response and become stable. The container C conveyed into the freeze-drying device is freeze-dried in the half-plugged state, and fully-plugged by, for example, a plugging mechanism, and then conveyed out of the freeze-drying device. In addition, in a case where the container C is an ampule or the like, the container C will not include the lid member C1. Thus, the container main body C2 will be unloaded in an open state and closed outside the freeze-drying device.

The cooling stage 13 includes shelfs. Each shelf has a holding surface that holds a container C in the freeze-drying chamber 11. The cooling stage 13 is configured to hold the containers C loaded from the loading door 12 on the holding surfaces. The cooling stage 13 decreases the temperature of each holding surface to a first temperature from the temperature of the external environment. The container C may be arranged on the holding surface after the temperature is set to the first temperature. The first temperature is set as a target temperature for the liquid M. In addition, the first temperature is set so that no liquid M will start spontaneous freezing during the exhaust mitigation process, and so that every liquid M will start spontaneous freezing during an exhaust intensification process. Thus, the first temperature is set to, for example, a temperature close to an equilibrium freezing point or less. The first temperature is, for example, any temperature within a range greater than or equal to a temperature that is lower than an equilibrium freezing point by 10° C. and less than or equal to a temperature that is lower than the equilibrium freezing point by 1° C. For example, if a filler described in Appendix C.2 Configuration a of JISC9801-1 is the liquid M, the first temperature is set within a range less than or equal to a temperature close to −1° C. and greater than or equal to −11° C. The temperature of the holding surface may be adjusted by a cooling medium passing through the cooling stage 1 or by a cooling medium passing through a wall of the freeze-drying chamber 11.

In addition, from the viewpoint of forming a temperature gradient in the liquid M, it is desirable that a lower limit value of the first temperature be set to a temperature greater than or equal to a temperature for a first target value in the exhaust mitigation process. In one example of the first target value, a partial pressure value of water vapor is 315 Pa. Thus, one example of a temperature corresponding to the first target value is −9.2° C. Further, an example of the lower limit value of the first temperature is −8° C. The first temperature is set to such a lower limit value in order to ensure that a liquid surface side of the liquid M is lower than the bottom side of the container C. If the holding surface has a temperature time constant that is sufficiently smaller than the container C, when the container C is first arranged, the temperature of the holding surface is set to the first temperature or less, and the temperature of the holding surface set to the first temperature before the liquid M reaches the first temperature. This shortens the processing time required for freeze-drying.

The bottom wall of the container main body C2 discharges a heat amount to the holding surface through a portion where the holding surface and the container main body C2 are in contact. An outer wall of the container main body C2 discharges a heat amount to the inside of the freeze-drying chamber 11 through contact of internal gas in the freeze-drying chamber 11 and the container main body C2. The portion between the bottom wall and the outer wall of the container main body C2 differs from the portion between a rim portion and a center portion of the bottom wall in the discharged heat amount based on the heat capacity of the environment in contact with each portion.

In addition, the heat amount from the holding surface is discharged under a condition in which the loading door 12 and the main valve V are closed, that is, under a condition in which the freeze-drying chamber 11 is atmosphere-separated so that the exhaust heat of the liquid M and the container main body C2 are effective. With this configuration, the inflow of the heat amount from the external environment can be blocked, and a temperature of internal gas of the freeze-drying chamber 11 can be set to a substantially uniform temperature at the first temperature, and the heat amount can be discharge effectively by heat exchange using convection current. In addition, the freeze-drying chamber 11 approaches the first temperature after being atmosphere-separated. Thus, the atmosphere slightly becomes a negative pressure atmosphere from the aspect of atmospheric pressure, but does not disturb heat exchange using convection current. In addition, at this time point, heat removal is effective when the heat amount discharged using convection current is dominant. Thus, gas is not discharged inside the freeze-drying chamber 11 except for a gas adsorption effect on the holding surface.

From the viewpoint of production efficiency, after the loading door 12 and the main valve V are closed to decrease thermal resistance caused by a convection current, a plurality of containers C, that is, the liquid M may be cooled while pressurizing the internal atmosphere of the freeze-drying chamber 11. The series of processes are executed as pressurization processes during a preparation process. The pressurized internal atmosphere is, for example, 1.1 to 2 times greater than air. Air is pressurized and further dissolved in the liquid M. An upper limit of this range is set to a value at which an effect caused by pressurization is not impaired by an increase in volume of dissolved gas. In addition, a lower limit pressure of this range is set from the viewpoint of dissolving air trapped in the contact surface between the container main body C2 and the liquid M. Especially, in a case where air including water vapor trapped due to the surface roughness of the contact surface or the like remains until a boiling hindrance process (described later) is performed, the trapped air can be a bubble nucleus in an ice nucleus generation process to a freezing process, that is, a nucleus in heterogeneous nucleation. Such a nucleus causes a phenomenon similar to that caused by a nucleation agent thereby resulting in freezing at an unintended timing. By reducing the trapped air in advance, it becomes possible to decrease the stochasticity at which a bumping phenomenon will occurs. In addition, it is desirable that the pressurization of internal atmosphere ends before the liquid reaches the first temperature or the equilibrium freezing point, and an atmospheric pressure of the liquid M when the liquid reaches the first temperature is close to an atmospheric pressure. This is because a generation stochasticity of an ice nucleus rises due to a change in a depressurization direction of atmospheric pressure to which the liquid is exposed in a state in which the liquid is less than or equal to the equilibrium freezing point thereby resulting in unintended freezing.

In the liquid M from which a heat amount is discharged, a volume of gas dissolved in the liquid M is increased by an amount corresponding to a decrease in temperature of the liquid M. If a processing temperature is greater than or equal to −5° C. and less than or equal to −1° C. and the medium is water, the volume of the gas dissolved in the liquid M is, for example, 0.029 $cm^3$ in 1 $cm^3$ of water. The gas dissolved when the temperature of the liquid M decreases is internal gas of the freeze-drying chamber 11 that is atmosphere-separated.

The cryo-chamber CP is connected to the freeze-drying chamber 11 through the main valve V. The main valve V opens and closes the freeze-drying chamber 11. The main valve V closes the freeze-drying chamber 11 and hermetically seals the freeze-drying chamber 11 from a subsequent stage. The main valve V opens the freeze-drying chamber 11 to connect the inside of the freeze-drying chamber 11 and the inside of the cryo-chamber CP. The main valve V may be a valve switched between an open state and a closed state or a valve configured to change an open degree in the open state. The main valve V may be configured to take, for example, a closed state, an open state, and a half-open state. In addition, when the freeze-drying device functions at the rated exhaust capability of the freeze-drying chamber 11, the main valve V is in the open state, and the conductance value is maximum.

The cryo-chamber CP accommodates a cryo-trap CT. The cryo-trap CT is cooled to a predetermined temperature in order to adsorb a vaporized medium such as water. The cryo-trap CT adsorbs the vaporized medium existing in the cryo-chamber CP. When the main valve V opens, a medium vaporized in the freeze-drying chamber 11 enters the cryo-chamber CP from the freeze-drying chamber 11, and the cryo-trap CT adsorbs the vaporized medium entering the cryo-chamber CP. In other words, the cryo-trap CT decreases the medium density of the freeze-drying chamber 11 accommodating the liquid M, and smoothly removes the medium from the freeze-drying chamber 11. The temperature of the cryo-trap CT is set to any value within a range greater than or equal to −85° C. and less than or equal to −40° C. to adsorb the medium.

In addition, in a case where the cryo-trap CT functions at the rated exhaust capability, an operation is performed at a lower limit value reachable by the cryo-trap CT in the above-described temperature range. The actual exhaust capability increases and decreases in accordance with the situation in which the medium is adsorbed in the cryo-trap CT. However, such a variation range is included in the rated exhaust capability. More specifically, a state in which a reachable lower limit temperature is maintained for a medium cooling the cryo-trap CT is a rated exhaust state of the cryo-trap CT.

The vacuum pump P1 is connected to the cryo-chamber CP through the control valve V1. The control valve V1 opens and closes the cryo-chamber CP. The control valve V1 closes the cryo-chamber CP and hermetically seals the cryo-chamber CP from a subsequent stage. The control valve V1 opens the cryo-chamber CP to connect the inside of the cryo-chamber CP and the vacuum pump P1. The control valve V1 may be a valve switched between an open state and a closed state or be configured to change an open degree in the open state. The control valve V1 may be configured to take, for example, a closed state, an open state, and a half-open state. In addition, when the freeze-drying device functions at the rated exhaust capability of the cryo-chamber CP or the freeze-drying chamber 11, the control valve V1 is in the open state, and the conductance value is maximum.

The vacuum pump P1 is connected to the inside of the cryo-chamber CP and discharges gas from the cryo-chamber CP. When the main valve V and the control valve V1 are both open, the vacuum pump P1 is connected to the inside of the freeze-drying chamber 11 through the cryo-chamber CP to discharge gas from the freeze-drying chamber 11. Gas entering the cryo-chamber CP from the freeze-drying chamber 11 is adsorbed by the cryo-trap CT or discharged by the vacuum pump P1.

The vacuum pump P1 is a positive-displacement pump. The vacuum pump P1 may be a single-stage pump or a multistage pump. The vacuum pump P1 is formed by, for example, a roots blower pump and a vane pump that are connected in series. An exhaust speed of the vacuum pump P1 may be constant. The exhaust speed may be, for example, variable or switchable by changing a volume displacement amount per unit time.

A case in which the vacuum pump P1 functions at the rated exhaust capability is, for example, equivalent to a case in which an induction motor driving the vacuum pump P1 is the rated rotational speed. In other words, the volume displacement amount per unit time is the same as a rated value of a drive device of a vacuum pump. In the same manner as the cryo-trap CT, the actual exhaust capability of the vacuum pump P1 varies in accordance with load that is the displaced gas volume. The variation is included in the rated exhaust capability.

A time transition of a pressure decrease of the freeze-drying chamber 11 when gas is discharged by the vacuum pump P1, that is, a transient state is regarded as a first order lag response. The transient state is determined by an exhaust speed of the vacuum pump P1, an atmospheric pressure that is an initial pressure, a pressure used for freeze-drying, a volume of the freeze-drying chamber 11, a ratio of condensable gas and non-condensable gas in the freeze-drying chamber 11, an exhaust time until the pressure reaches the pressure used for freeze-drying, and the like. The positive-displacement pump obtains a high exhaust speed in low vacuum (JISZ8126-1) but the exhaust capability gradually decreases in medium vacuum or higher. Thus, when the pressure inside the freeze-drying chamber 11 is medium vacuum or higher, the cryo-trap CT, which is a gas capture pump, controls the exhaust speed of the freeze-drying chamber 11. This is also because a ratio of moisture, which is condensable gas, in the atmosphere of the freeze-drying chamber 11 increases as the discharge of gas from the freeze-drying chamber 11 advances.

The controller 21 includes hardware components used in a computer such as a central processing unit (CPU), a random access memory (RAM), and a read-only memory (ROM), for example, and software. The controller 21 does not have to use software to perform each and every process. For example, the controller 21 may include an integrated circuit applied to perform a determination that is dedicated hardware for executing at least some of the processes. The controller 21 may be formed by one or more dedicated hardware circuits such as an application specific integrated circuit (ASIC), a microcomputer of one or more processors running on software that is a computer program, or a circuit including a combination of the above. The controller 21 stores a program for controlling the driving of each functional unit. The controller 21 executes a program to control and driving the cooling stage 13, the vacuum pump P1, the cryo-trap CT, the main valve V, the control valve V1, and the like.

The controller 21 arranges the container C on the cooling stage 13 and cools the cooling stage 13 to the first temperature. For example, the cooling stage 13 includes a sensor that detects the temperature of the cooling stage 13 or the temperature of a cooling medium flowing in the cooling stage 13. The controller 21 may adjust the temperature of a cooling medium flowing in the cooling stage 13 so that a temperature detected by the sensor becomes the first temperature.

The controller 21 starts driving the vacuum pump P1 so that the vacuum pump P1 discharges gas from the cryo-chamber CP. For example, the controller 21 discharges gas from the cryo-chamber CP with the vacuum pump P1 so that the pressure of the cryo-chamber CP becomes suitable for driving the cryo-trap CT. The controller 21 discharges gas from the freeze-drying chamber 11 through the cryo-chamber CP with the vacuum pump P1.

The controller 21 starts driving of the cryo-trap CT to discharge gas by adsorbing the vaporized medium with the cryo-trap CT. For example, the controller 21 discharges gas by driving the vacuum pump Pt to depressurize the cryo-chamber CP and drawing in vaporized medium from the freeze-drying chamber 11 while simultaneously adsorbing the medium with the cryo-trap CT. In addition, as the cryo-trap CT adsorbs the medium to discharge gas, the controller 21 draws the vaporized medium from the freeze-drying chamber 11 into the cryo-chamber CP. Then, the controller 21 dries the freeze-drying chamber 11 for an amount corresponding to the amount of the medium adsorbed by the cryo-trap CT.

Preparation Process

The controller 21 is configured to execute a preparation process.

The preparation process is performed prior to an exhaust process of the freeze-drying chamber 11. The preparation process is executed to decrease the temperature of the liquid M to an exhaust process initiation temperature. The controller 21 is configured to execute the preparation process until the temperature of the liquid M becomes the exhaust process initiation temperature or the temperature of the liquid M can be regarded as the exhaust process initiation temperature. In addition, the exhaust process ends upon initiation of pressure recovery, which will be described later. This does not mean that the cryo-trap CT and the vacuum pump P1 used to discharge gas from the freeze-drying chamber 11 will be stopped.

In the preparation process, the controller 21 arranges a container C, which is in a half-plugged state, on a shelf of the cooling stage 13 while maintaining the main valve V in a closed state and then closes the loading door 12. Thus, the controller 21 separates the atmosphere of the container C from the external environment of the freeze-drying device. Further, in the preparation process, the controller 21 drives the cooling stage 13 so that the temperature at the holding surface of the shelf is kept at the first temperature. This removes the heat amount of the liquid M so that the temperature approaches the exhaust process initiation temperature. In addition, the cooling stage 13 may be driven in advance so that the container C is arranged on the shelf in a state in which the temperature of the shelf is the first temperature. Then, the loading door 12 may be closed. This is preferable from the aspect of production efficiency.

In the preparation process, the controller 21 determines whether the temperature of the liquid M has reached the predetermined exhaust process initiation temperature during a period in which the main valve V is closed. The value measured as the exhaust process initiation temperature is a directly obtained value obtained by measuring the temperature of the container or liquid or an indirectly obtained value obtained through an estimation using the temperatures of the shelf or cooling medium and a time constant set in advance. In addition, a value used for determination may be, for example, a predetermined temperature set in advance in the controller 21. The set value is compared with a measurement value to perform a determination. If the controller 21 determines that the temperature of the liquid M accommodated in the freeze-drying chamber 11 has reached the exhaust process initiation temperature, the controller 21 switches the main valve V from the closed state to the open state, and thereby ends the preparation process to shift to the exhaust process.

Before the preparation process is executed, the temperature of the liquid M is about the same as the temperature of the external environment of the freeze-drying device. If preparation process is executed, the temperature of the liquid M inside the freeze-drying chamber 11, which is atmosphere-separated, decreases from the temperature that is the same as the temperature of the external environment to the first temperature, which is the temperature of the shelf. At the same time, the temperature of the internal atmosphere of the freeze-drying chamber 11 also shifts when the loading door 12 is closed to a temperature corresponding to the first temperature from the temperature that is the same as the temperature of the external environment, and the pressure of the internal atmosphere becomes lower than the ambient atmosphere. Then, a volume of gas, which corresponds to a difference in solubility between the external environment temperature and the first temperature, dissolves in the liquid M. The amount of gas that dissolves in the liquid M can be obtained by applying the pressure of the freeze-drying chamber 11 to a solubility curve. During preparation process, when the internal atmosphere of the freeze-drying chamber 11 is pressurized to, for example, 1.1 atmospheric pressure, the volume of gas that dissolves in the liquid M is based on a solubility curve and the pressure at the stage where pressurization ends, that is, at a time point at which the liquid M reaches the first temperature.

In addition, in a case where a direct measurement method is used to detect the temperature of the liquid surface of the liquid M, a radiation thermometer, a thermocouple, or the like may be used. In a case where an indirect measurement method is used, measurement of an elapsed time that is based on a heat circuit model and results of a plurality of times of experiments may be used, and an estimated value that uses a temperature of another point such as a cooling medium input point or an output point may be used. The elapsed time is the time elapsed from when, for example, the accommodating of the container C is completed. The temperature detection of the liquid surface does not necessarily have to be performed during preparation process, but the temperature of the liquid surface of the liquid M needs to be decreased to less than or equal to the equilibrium freezing point in an exhaust intensification process that is executed afterward. In other words, an allowable range of the exhaust process initiation temperature that does not disturb vacuum-induced surface freezing may be set based on the stochasticity of success or failure in experiments and the like. In the present embodiment, the controller 21 used the time elapsed from when the accommodation of the container C is completed to determine that the temperature of the liquid surface of the liquid M has reached the exhaust process initiation temperature when the elapsed time matches a prestored target time by the controller 21.

Exhaust Mitigation Process

The controller 21 is configured to execute an exhaust mitigation process. The difference between a start time point of the exhaust process and a start time point of the exhaust mitigation process will be described later.

The exhaust mitigation process is one type of exhaust processing. The exhaust mitigation process is executed before an ice nucleus is generated on the liquid M. The exhaust mitigation process removes dissolved gas from the liquid M and forms a temperature gradient from an upper layer of the liquid M toward a lower layer. The processing of removing dissolved gas also serves as preparation process performed for preventing a bumping phenomenon. By removing dissolved gas and simultaneously continuing vaporization that is phase transition of the medium on the liquid surface of the liquid M, the exhaust mitigation process selectively cools the liquid surface, and forms a temperature gradient. The controller 21 is configured to execute the exhaust mitigation process until the pressure of the freeze-drying chamber 11 reaches the first target value. The controller 21 executes the exhaust mitigation process until the pressure of the freeze-drying chamber 11 reaches the first target value, and shifts the temperature of the liquid surface from the liquid phase side of a melting curve of the medium to the solid phase side.

The controller 21 executes a low-speed exhaust process as the exhaust mitigation process. The low-speed exhaust process discharges gas from the freeze-drying chamber 11 with a capability smaller than rated exhaust capability. It is difficult to vary the rated exhaust capability of a pump in a typical freeze-drying device. Thus, it is desirable that the conductance of a path of the discharge gas be changed. In one example, the low-speed exhaust process is implemented by switching the control valve V1 between the open state and the closed state in predetermined time intervals while maintaining the main valve V in an open state to vary the conductance value of a path through which gas is discharged from the freeze-drying chamber 11 to a pump. For example, the low-speed exhaust process is executed by switching the control valve V1 between the open state and the closed state every 30 seconds. An opened/closed time and a duty ratio of the control valve V1 are set accordance with a conductance value corresponding to the required product quality or the physicality of the liquid M. In one example, while the low-speed exhaust process decreases a conductance value of a path that discharges non-condensable gas and extends toward the vacuum pump P1, the low-speed exhaust process does not change the conductance value of a path that discharges condensable gas and extends toward the cryo-trap CT.

In this manner, the controller 21 executes the exhaust mitigation process by executing the low-speed exhaust process. A transient response of a total pressure value in the freeze-drying chamber 11 during the exhaust mitigation process is confirmed as a transient response with mitigated transition of a total pressure value as compared with that confirmed at the time of rated exhaust capability. A transient response of a partial pressure value in the freeze-drying chamber 11 during the exhaust mitigation process is also confirmed as a transient response with mitigated transition of a partial pressure value as compared with that confirmed at the time of rated exhaust capability. The mitigation of pressure transition can be confirmed by, for example, an increase in the elapsed time until a pressure shifts to a predetermined pressure. In other words, the exhaust mitigation process sets the time until a total pressure value reaches a predetermined total pressure value to be longer than processing at the rated exhaust capability. In addition, the exhaust mitigation process sets the time until a partial pressure value reaches a predetermined partial pressure value to be longer than processing at the rated exhaust capability. Thus, the time in which the liquid surface of the liquid M is depressed also becomes longer, the effect of decreasing a temperature of the liquid surface of the liquid M is enhanced, and the latent heat amount generated by vaporization also increases in proportion to the extended time.

In addition, in the period in which the low-speed exhaust process is executed, the conductance value of a path from the freeze-drying chamber 11 to the cryo-trap CT does not change. Thus, condensable gas is discharged from the freeze-drying chamber 11 at the rated exhaust capability of the cryo-trap CT. In other words, a state in which the rated exhaust capability of the cryo-trap CT is maintained is continued for the discharge of condensable gas. Water vapor that is condensable gas continues to be discharged from the freeze-drying chamber 11 at the rated exhaust capability of the cryo-trap CT. In other words, the vaporization of the medium on the liquid surface of the liquid M is not fully impeded, and the medium vaporized from the liquid surface of the liquid M continues to be adsorbed by the cryo-trap CT and simultaneously continues to draw more latent heat from the liquid surface of the liquid M. This further decreases the temperature of the liquid surface of the liquid M.

The controller 21 executes the exhaust mitigation process until a partial pressure value of condensable gas in the freeze-drying chamber 11 reaches the first target value. The first target value may be a total pressure value in the freeze-drying chamber 11 that has been converted from a partial pressure value. As one example of the first target value, a total pressure value is 700 Pa, and a partial pressure value of water, which is a medium, is 315±10%. Using a partial pressure value of a medium without using a total pressure value allows the liquid surface temperature of the liquid M obtained by the first target value conforms to the liquid surface temperature of the liquid M required when the exhaust mitigation process ends.

The first target value is set in a latter half of the exhaust mitigation process as a partial pressure value close to a partial pressure value at which the liquid M does not start spontaneous freezing or as a total pressure value estimated to include the partial pressure value. Specifically, after a processing time or the like is determined, a starting stochasticity of spontaneous freezing under the condition is obtained in advance, and the first target value is set as a partial pressure value corresponding to a temperature less than or equal to an allowable stochasticity. The partial pressure value may be set based on results of experiments. For example, a partial pressure value can be set in advance by referring to a value indicated in FIG. 8 of Netsu Bussei (Japan Journal of Thermophysical Properties) 8 [4] (1994) 256/262 Topic: Snow/Ice and Utilization Technology "Supercooling Phenomenon of Water" with regard to the starting stochasticity of spontaneous freezing. According to experiments conducted in advance, an allowable stochasticity in an example can be ensured by setting a temperature to about −9° C. or larger. A partial pressure value of water vapor at the temperature is set to about 310 Pa based on a saturation vapor pressure of water of supercooling in Appendix Table 1.2 of JISZ8806. Based on this, the first target value is set to 310 Pa as a partial pressure value.

The stochasticity of a temperature at which spontaneous freezing will start is in accordance with not only the liquid M but also the inner surface characteristics of the container C. Thus, when conditions change, the stochasticity needs to be obtained in advance. In the embodiments described above, the liquid M is mannitol solution (5 w/v %, equilibrium freezing-point depression is about −0.5° C.), and a commercially available vial, which is made of borosilicate glass and subjected to precision cleaning, is used as the container C.

As described above, the exhaust mitigation process selectively cools the liquid surface of the liquid M, sets the temperature of the liquid surface to the minimum temperature in the liquid M, and discharges the dissolved gas of the liquid M. If an ice nucleus is generated in part of the liquid M during the exhaust mitigation process due to an exhaust mitigation process condition for excessively cooling the liquid M or a vibration condition resulting from the driving of a shelf or an auxiliary machine, freezing will progress in that part of the liquid M. In addition, if dissolved gas is not discharged sufficiently, bubbles will be formed in the exhaust mitigation process, which is performed next. Even if bubbles are not formed, when freezing occurs in the next process, the condensation of dissolved gas resulting from a decrease in liquid phase will increase the stochasticity of fine bubbles being formed to such an extent that bubble formation of dissolved gas will occur or a gas phase nucleus of heterogeneous nucleation of the medium will be generated. Thus, the controller 21 sets the conditions of the exhaust mitigation process in such a manner as to exclude such excessive cooling, vibration, and dissolved gas.

For example, the temperature of the holding surface in the exhaust mitigation process is set to a temperature that is greater than or equal to a temperature on a vapor pressure curve of the medium corresponding to a pressure of the freeze-drying chamber 11 and greater than or equal to a temperature corresponding to a partial pressure value of the medium when the pressure of the freeze-drying chamber 11 is the first target value. With this configuration, it is possible to avoid excessive cooling in the exhaust mitigation process and also form a temperature gradient increasing from the liquid surface of the liquid M toward the bottom surface of the container C. For example, if an equilibrium freezing point at an atmospheric pressure of the liquid M is −1° C., a partial pressure value of the medium when the pressure of the freeze-drying chamber 11 is the first target value is regarded as a saturation vapor pressure of the medium, the temperature corresponding to the saturation vapor pressure is −8° C. to −10° C., and the temperature of the holding surface in the exhaust mitigation process is set to about −4.5° C. to −7.5° C. The temperature of the holding surface is thereby set taking into consideration the heat removal amount generated when a phase transitions to a gas phase from the liquid surface of the liquid M and the temperature gradient between the liquid surface of the liquid M and the holding surface.

In addition, the controller 21 may change the temperature of the holding surface during the exhaust mitigation process and set the temperature of the holding surface in the exhaust mitigation process to a temperature higher than the first temperature set before the exhaust mitigation process to avoid excessive cooling and vibration. For example, the temperature of the holding surface for when the container C is accommodated can be set to a temperature lower than the first temperature set before the exhaust mitigation process to shorten the time until the temperature of the liquid surface of the liquid M reaches the exhaust process initiation temperature from the time at which the accommodation of the container C. This has an effect that increases the production efficiency. In addition, by setting the temperature of the holding surface in the exhaust mitigation process to a temperature higher than the first temperature set before the exhaust mitigation process, it becomes possible to minimize increases in the starting stochasticity of spontaneous freezing and form a temperature gradient that increase from the surface of the liquid M toward the bottom surface of the container C. With this configuration, the stochasticity of simultaneous ice nucleation in all liquids during the exhaust intensification process, which will be described later, can be increased.

In addition, the detection of a partial pressure value in the freeze-drying device may be either direct measurement or indirect measurement. A direct measurement method is a method that uses, for example, a quadrupolar mass spectrometer or infrared absorption spectroscopy. An indirect measurement method is a method that uses, for example, a diaphragm gauge and a Pirani gauge in combination. Additionally, the controller 21 may store, in advance, conversion information such as a table or a relational expression associating a partial pressure value with a total pressure value in the freeze-drying chamber 11 to estimate a partial pressure value by applying the total pressure value of the freeze-drying chamber 11 to the conversion information. In a specific example, the partial pressure value is estimated from a stored table or a relational expression associating the difference in pressure values of the Pirani gauge and the diaphragm gauge using the gaseous species dependency of the Pirani gauge, which is a thermal conductivity gauge.

In addition, depressurization is performed during the exhaust mitigation process within a range extending to the first target value. However, the controller 21 can change the set first target value in accordance with the required product quality or liquid physicality. In addition, the controller 21 may set target values other than the first target value in the pressure range extending to the first target value. For each target value, the controller 21 may set an exhaust stop period and an exhaust continuance period to reach the target value. For example, to discharge the gas dissolved in the liquid M, an exhaust speed in a first half period of the exhaust mitigation process is decreased, and an exhaust speed in the following period is increased. This allows for gas discharge that limits bubble formation caused by medium vaporization in correspondence with the viscosity of the liquid M and shortens the time until a value reaches the first target value. In a case where selective cooling in the liquid surface of the liquid M is sufficiently performed, the controller 21 may add a process for increasing an exhaust speed and then decreasing the exhaust speed. This will increase heat removal even when the time until a value reaches the first target value is the same.

In a case where the controller 21 sets target values other than the first target value and executes the exhaust mitigation process at multistage exhaust speeds, the medium of the liquid M can be vaporized in accordance with the physicality of the liquid M, the gas dissolved in the liquid M can be gradually eliminated from the liquid M, and the heat amount can be simultaneously removed from the liquid surface of the liquid M. This allows the controller 21 to desorb the gas dissolved in the liquid M as a gas phase in the exhaust mitigation process without generating a bubble nucleus in the liquid M in the next process and selectively cool the liquid surface of the liquid M in the process following the exhaust mitigation process.

The controller 21 may be configured to execute a program stored in the controller 21 to start the exhaust mitigation process as preparation process ends and execute the exhaust mitigation process until the pressure of the freeze-drying chamber 11 reaches the first target value. Alternatively, the controller 21 may execute a program stored in the controller 21 to fully open the control valve V1 as preparation process ends, depressurize the freeze-drying chamber 11 in a pressure transition state greater than or equal to the rated exhaust capability until reaching a zeroth target value, and start the exhaust mitigation process as the pressure of the freeze-drying chamber 11 reaches the zeroth target value. In this manner, if the controller 21 is configured to set the zeroth target value, even if the time from time point t1 to a timing t3 of FIG. 2 does not change, the time in which the liquid surface of the liquid M is subjected to depressurization during the exhaust mitigation process becomes longer. In addition, the effect for decreasing the temperature of the liquid surface of the liquid M is enhanced, and the effect for releasing dissolved gas from the liquid M is also enhanced. This allows the mitigation process to be executed with further efficiency from the viewpoint of production efficiency. As a matter of course, the zeroth target value is set within the range in which a bumping phenomenon does not occur in the liquid M. The zeroth target value may be a partial pressure value of the medium in the freeze-drying chamber 11 or a total pressure value of the freeze-drying chamber 11 that is estimated from the partial pressure value.

In this manner, depressurization until reaching the zeroth target value in a pressure transition state that is greater than or equal to the rated exhaust capability improves production efficiency. In a case where product quality enhance is requested, the exhaust mitigation process may be started after preparation process end without executing depressurization at an exhaust capability greater than or equal to rated exhaust capability. If the contamination stochasticity of the liquid surface of the liquid M needs to be decreased, it is preferable that the exhaust mitigation process be performed after preparation process ends. As described above, for example, the contamination stochasticity is decreased by managing an ambient environment of the container C in compliance with the above-described cleanliness class N5. In addition, the period of exhaust mitigation process is set to the period from when depressurization is started to when the pressure reaches the first target value, the contamination stochasticity of the liquid surface of the liquid M can be further decreased. In other words, when the kinetic energy of gas in the ambient environment of the container C is set in accordance with a state in which gas is discharged at the rated exhaust capability or less, the energy applied to a foreign substance in the environment can be relatively decreased, and the stochasticity at which the foreign substance reaches the inside of the container C can be decreased. In other words, ice nucleation (heterogeneous nucleation) resulting from a foreign substance is prevented, and the defective rate of products can be reduced. Hereinafter, any processing resulting in pressure transition greater than or equal to the rated exhaust capability when discharging gas from the freeze-drying chamber 11 will be referred to as a high-speed exhaust process.

Exhaust Intensification Process

The controller 21 is configured to execute the exhaust intensification process subsequent to the exhaust mitigation process. The exhaust intensification process is one type of exhaust processing. In addition, the exhaust intensification process is executed as a final exhaust process. In the exhaust intensification process, a transient response of a pressure in the freeze-drying chamber 11 is observed as a response of a high-speed exhaust process. Then, the exhaust intensification process sets the pressure of the container C to a pressure less than or equal to a pressure on a sublimation curve, which is a pressure of a gas phase region of the medium, immediately before a boiling hindrance process, that is, a process for steeply raising the pressure of the freeze-drying chamber 11, which will be described later. This selectively cools the liquid surface of the liquid M, generates crystals (i.e., ice nucleus) in a large part of or the entire region of the liquid surface, and grows crystals in the subsequent process.

An example of high-speed exhaust process performed by the controller 21 as the exhaust intensification process will now be described. The controller 21 maintains the control valve V1 in the open state while maintaining the main valve V in the open state. In other words, the controller 21 maintains the conductance of a path from the freeze-drying chamber 11 to the vacuum pump P1 at the maximum conductance. Then, the controller 21 continues the discharge of gas from the freeze-drying chamber 11 with the cryo-trap CT, while continuing the discharge of gas from the cryo-chamber CP with the vacuum pump P1. In other words, the conductance of the path from the freeze-drying chamber 11 to the cryo-trap CT does not change from the maximum conductance. Thus, the controller 21 can thereby maintain a state in which selective cooling of the liquid surface of the liquid M is maximum, and switch a transient response of the pressure of the freeze-drying chamber 11 from the state of the exhaust mitigation process to the state of the exhaust intensification process.

The high-speed exhaust process is not limited to pressure transition at a rated exhaust speed in a freeze-drying device. For example, the controller 21 can implement high-speed exhaust process, in which the exhaust speed is greater than a rated exhaust speed, by performing short-time overload driving in which a volume displacement amount per unit time is increased by twenty percent from a rated value, for example, for the vacuum pump P1, which is a positive-displacement pump. Specifically, the controller 21 is only required to increase the rated rotational speed of a motor driving the vacuum pump P1 by twenty percent. As a specific example, the rated rotational speed is increased by an inverter. The inverter is implemented by applying a frequency that is 1.2 times greater than the rated frequency to the motor driving the vacuum pump P1. Driving the motor for a long time at a rotational speed greater than or equal to the rated rotational speed may lead to overheating. Nevertheless, the time required for the high-speed exhaust process is short, and the motor is driven within the range of short-time rating of the motor and the inverter, the high-speed exhaust process can be driven within a range allowed by the conventional design. As another method, the controller 21 may temporarily close the main valve V when starting the exhaust intensification process and open the main valve V after discharging gas until the pressure of the cryo-chamber CP reaches a second target value or a pressure less than or equal to the second target value. With this configuration, the cryo-chamber CP functions as a negative-pressure accumulator. For example, if a volume ratio between the cryo-chamber CP and the freeze-drying chamber 11 is 1:1, by setting the pressure value of the cryo-chamber CP to a pressure value less than or equal to 50% of the second target value and then opening the main valve V, the cryo-chamber CP can be effectively operated as a negative-pressure accumulator. With this configuration, the cryo-chamber CP can be operated as a depressurization source (i.e., additional pump). This allows the exhaust speed to be greater than the rated exhaust speed. By employing such a method, the controller 21 implements the high-speed exhaust process having a higher speed than pressure transition at the rated maximum exhaust speed in the freeze-drying device. The condensable gas exhaust capability of a positive-displacement pump is low and within the range from the first target value to the second target value. Thus, from the viewpoint of discharging a medium such as moisture at a high speed, it is preferable that the cryo-chamber CP function as a negative-pressure accumulator.

The controller 21 is configured to execute the exhaust intensification process until the pressure of the freeze-drying chamber 11 reaches the second target value. The second target value is a partial pressure value in the freeze-drying chamber 11. When the medium is water, the second target value is, for example, 40 Pa. The second target value is a pressure that guides a temperature for generating an ice nucleus in a large portion of the liquid surface of the liquid M or a contact portion of an inner wall of the container C and the liquid surface of the liquid M. As described above, the first target value is a pressure forming a gradient in which the temperature decreases from the liquid surface of the liquid M and a pressure generating little or no ice nucleus on the liquid surface of the liquid M during the exhaust mitigation process. In contrast, the second target value is a pressure for generating an ice nucleus in a large portion of the liquid M or for generating an ice nucleus in the entire container C. In addition, ice nucleation means that the medium in the solid phase does not shift to the liquid phase and disappear. Ice nucleation does not mean that an ice nucleus grows over the entire region of the liquid M.

As described above, when a transient response of a pressure in the freeze-drying chamber 11 is observed as a result obtained by the high-speed exhaust process from the first target value to the second target value, cooling promptly progresses in a large portion of the liquid surface of the liquid M or in the entire liquid surface. Thus, ice nucleation progresses substantially at the same time in a large portion of the liquid surface and at least during the high-speed exhaust process. Moreover, high-speed exhaust process results in a transient response from the first target value to the second target value. Thus, the time required for transition from the first target value to the second target value is short, and bubble formation does not occur in the liquid M.

The liquid surface of the liquid M, which is a gas-liquid interface of a medium, is free from a medium with a configuration having a grating constant for promoting ice nucleation. For example, there is no medium corresponding to a nucleation agent such as silver iodide or ice-active protein. Thus, an ice nucleus is not likely to be generated on the liquid surface of the liquid M. To generate an ice nucleus at substantially the same time over a large portion of the liquid surface or over the entire liquid surface, sufficiently strong supercooling needs to be performed over a wide range. Further, even though there is no convection current of the liquid M, the thermal resistance resulting from contact thermal conductance is small. Thus, thermal resistance in a lower layer direction from the liquid surface hinders cooling that generates strong supercooling over the entire liquid surface of the liquid M. The present inventors have found the two physical phenomena described below can be simultaneously used to set a cool temperate portion in the liquid surface of the liquid M. The first physical phenomenon is heat removal resulting from the equilibrium of a saturation vapor pressure and an environmental pressure. The second physical phenomenon is heat removal in a region surrounded by bubble nucleus on the liquid surface of the liquid M. To set a local cool temperate portion in the liquid surface of the liquid M by using these two physical phenomena, that is, to advance heat removal resulting from gas-liquid equilibrium and heat removal resulting from bubble nucleus, the upper limit value of the second target value is set by the controller 21 to any value within the pressure range in which three forms of the medium correspond to the gas phase.

Then, as the controller 21 advances the exhaust intensification process, three-forms of the medium in the liquid surface of the liquid M shift to the gas phase, and bubble nucleus, which is a thermodynamic phenomenon similar to ice nucleus, is generated. According to tests conducted by the inventors, bubble nucleus is more likely to be generated in the gas-liquid interface than the inside of the liquid M, and, particularly, in a region of the gas-liquid interface that contacts the inner wall of the container C. At the initial stage of the exhaust intensification process, small bubble nucleuses generate and grow at a number of points in the liquid surface, particularly, at the rim of the liquid surface of the liquid M. This draws a heat amount from the periphery of the bubble nucleuses. In addition, the size of the small bubble nucleuses is such that visual recognition is not possible and the diameter is several μm or less. In addition, the bubble nucleus will not affect the outer appearance of a product since it cannot be visually recognized because of size.

When movement of heat amount caused by bubble nucleuses is regarded as a heat flux on the liquid surface, the heat flux directed toward the fine bubble nucleuses removes heat from the region surrounded by the bubble nucleuses. In this case, the temperature distribution on the liquid surface of the liquid M leads to an anisotropic property of a temperature distribution resulting from the heat flux heading for bubble nucleuses. In addition, an accelerated increase of heat removal resulting from the growth of bubble nucleuses also accelerates the increase in the anisotropic property of the temperature distribution, and forms a low temperature region in a large portion of the liquid surface of the liquid M. Then, temperature fluctuation in part of the liquid surface of the liquid M spreads throughout the entire liquid surface of the liquid M so that each part exceeds a supercooling limit at each part and an ice nucleus is generated at the same time in the most of or all of the liquid surface of the liquid M.

If the medium of the liquid M is water when ice nucleation of the liquid M is homogeneous nucleation, the temperature of the liquid M that can be set before the ice nucleus grows is approximately −40° C., which is a lower limit value of supercooling. In a case where the temperature of the liquid M is set to the lower limit value of supercooling only by depressurization of the freeze-drying chamber 11, a water partial pressure value becomes approximately 19 Pa based on Appendix Table 1.2 of JISZ8806, and a total pressure value in the freeze-drying device in an example becomes approximately 40 Pa. Nevertheless, the inventors have found that ice nucleation of the liquid M actually depends on inner surface characteristics and the like of the container C in the rim portion on the liquid surface, and heterogeneous nucleation is a dominant phenomenon. In addition, if the second target value is set to 19 Pa, which is a pressure value corresponding to the lower limit value of supercooling, for example, a partial pressure value when the medium is water, in the boiling hindrance process following the exhaust intensification process, the generation and growth of bubble nucleus in the liquid M may not be sufficiently hindered. In other words, the likelihood of bubble formation increases during pressure recovery to an atmospheric pressure. This is because the propagation speed of pressure waves transmitted from the liquid surface of the liquid M to the inside of the liquid M is heterogeneous inside the liquid M. Thus, an ideal lower limit value of the second target value is a partial pressure value of the medium at a homogeneous nucleation temperature, and an upper limit value is a pressure value less than or equal to a partial pressure value corresponding to a heterogeneous nucleation temperature in a liquid surface rim portion of the liquid M. It is sufficient that heterogeneous nucleation temperatures are obtained as a distribution through experiments, and, for example, a lower limit side temperature of 3σ range that is used is obtained when the distribution is a normal distribution. When setting a pressure value that is less than or equal to a partial pressure value corresponding to the lower limit side temperature, the generation of an ice nucleus is ensured, and the generation of a bubble nucleus is hindered at a maximum extent.

When the controller 21 sets the second target value as described above, the liquid surface of the liquid M can be cooled. Further, boiling of the liquid M and a bumping phenomenon during the boiling hindrance process, which is performed subsequently, are hindered, and generation and growth of gas phase nucleus in the liquid M are hindered. Ideally, the pressure value corresponds to a heterogeneous nucleation temperature that is the temperature resulting from the formation of a bubble nucleus in the liquid surface of the liquid M. Specifically, the pressure value estimated with a phase diagram indicating three forms of the medium corresponding to the temperature can used as the second target value. The second target value is not a total pressure value but is a partial pressure value of the medium. This allows the freeze-drying device to finely control the state of the liquid surface of the liquid M.

In an example that will now be described, a temperature fluctuation caused by bubble nucleus or the like, or the 3σ range of heterogeneous nucleation temperature, is estimated to be from −10° C. to −25° C.

In each experimental example, a mannitol solution of 5 w/v % was used as the liquid M. The ideal lower limit value corresponding to the second target value is approximately −40° C. A container made of borosilicate glass was used as the container C. and the liquid M was dispensed in the container C, which was subjected to precision cleaning.

In experimental example 1, −5° C. was added as a safety value, and 51 Pa, which is the water partial pressure value at −30° C., was set as the second target value. The second target value is 100 Pa that is a total pressure value converted from 51 Pa, which is a partial pressure value. In experimental example 1, twenty-four products, that is, every product, was non-defective, and a defective rate obtained through visual inspection was 0%.

In experimental example 2, 102 Pa, which is the water partial pressure value at −22° C., was set as the second target value. In addition, the second target value can also be 200 Pa that is a total pressure value converted from 102 Pa, which is a partial pressure value. In experimental example 2, the defective rate obtained through visual inspection was 0%.

In experimental example 3, 15 Pa, which is the water partial pressure value at −40° C., was set as the second target value. In addition, the second target value can also be 30 Pa that is a total pressure value converted from 15 Pa, which is a partial pressure value. In experimental example 3, even though the boiling hindrance process, which will be described later was performed, a bumping phenomenon occurred in some of the liquids M, and three out of thirteen products were defective. Further, the defective rate obtained through visual inspection was 25%.

In experimental example 4, 306 Pa, which is the water partial pressure value at −9° C., was used set as the second target value. In addition, the second target value can also be 600 Pa that is a total pressure value converted from 306 Pa, which is a partial pressure value. In experimental example 4, freezing did not occur.

Boiling Hindrance Process

The controller 21 is configured to execute the boiling hindrance process subsequent to the exhaust intensification process. The boiling hindrance process is executed immediately after the exhaust process to promptly return the pressure of the freeze-drying chamber 11 to the atmospheric pressure. The boiling hindrance process hinders the generation of a gas phase nucleus and the growth of a phase nucleus. That is, the boiling hindrance process hinders bubble nucleus generation and bubble nucleus growth in the liquid M. This is the final process (pressure transition) for hindering a bumping phenomenon.

In the boiling hindrance process, the controller 21 initially switches the main valve V from the open state to the closed state. Subsequently, the controller 21 switches a vent valve V0 from the closed state to the open state.

Before and after the main valve V switches to the closed state, that is, before and after a conductance value for gas discharged from the freeze-drying chamber 11 becomes the local minimum, the temperature of the liquid surface of the liquid M in the freeze-drying chamber 11 rises toward a triple point as a state of three-phase phase coexistence in which an ice nucleus is generated and the ice nucleus starts to grow. In the same manner, the internal temperature of the liquid M rises toward a point on a melting curve of the medium as a state in which two phases corresponding to the solid phase and the liquid phase coexist. In other words, after the main valve V switches to the closed state, due to vaporization of the medium, the pressure of the freeze-drying chamber 11 rises from the second target value toward a saturation vapor pressure of the medium at the triple point. For example, in a case where the medium of the liquid M is water, the pressure of the freeze-drying chamber 11 rises to approximately 611 Pa that is a saturation vapor pressure at approximately 0° C., which is the triple point of water. Nevertheless, the gas supplied by vaporization of the medium is limited by the heat balance of the liquid M. Thus, the rising speed of the pressure of the freeze-drying chamber 11 is extremely low, and the generation of bubble nucleus in the liquid M continues to be accelerated. In other words, bubble nucleus generation cannot be hindered only by a pressure rising factor that is inherent to the freeze-drying chamber 11. Thus, air needs to be drawn in quickly from the vent valve V0, which will be described later.

When the vent valve V0 is switched to the open state, air is drawn into the freeze-drying chamber 11, and the pressure of the freeze-drying chamber 11 promptly returns to the atmospheric pressure. The prompt pressure resulting from the promptly drawn in air changes the pressure of the freeze-drying chamber 11 to a pressure greater than or equal to a pressure of the triple point. This hinder the generation of bubble nucleus in the liquid M and the growth of bubble nucleus. The controller 21 may control the vent valve V0 to switch to the open state before the main valve V is switched to the closed state. In addition, the controller 21 may start the boiling hindrance process by closing the control valve V1 instead of the main valve V, and opening the vent valve V0 simultaneously or subsequently. Generally, the time responsivity of the control valve V1 is superior to that of the main valve V, and the medium continues to be discharged to the cryo-chamber CP until the vent valve V0 open. Thus, each control described above is advantageous since the production efficiency can be improved.

In addition, if the generation of bubble nucleus and the growth of bubble nucleus in the liquid M can be hindered, the controller 21 may switch the vent valve V0 from the closed state to the open state in a state in which the main valve V is maintained at the open state. In addition, to hinder bubble nucleus generation and bubble nucleus growth, the controller 21 is only required to return the pressure of the freeze-drying chamber 11 to any pressure within a range that is greater than or equal to the triple point and less than or equal to the atmospheric pressure. Nevertheless, when decreasing the thermal resistance between the holding surface and the container C to simplify control of the temperature of the liquid M, it is preferable that the controller 21 return the pressure to a pressure close to the atmospheric pressure.

Freeze-Drying Method

Next, a freeze-drying method executed by the freeze-drying device will be described with reference to FIGS. 1 and 2. In the following description, the medium of the liquid M is water. In addition, example in which the controller 21 sets a state of a pressure transient response between the preparation process and the exhaust mitigation process as high-speed exhaust process will be described. In addition. FIG. 2 illustrates an example in which a zeroth target value is included. However, this may be excluded when the freeze-drying method is executed.

The controller 21 first starts the above-described preparation process (time point t0 in FIG. 2) and starts to decrease the temperature of the liquid surface of the liquid M to the exhaust process initiation temperature. In addition, in a period in which the inside of the freeze-drying chamber 11 is separated from an external environment, the controller 21 drives the cryo-trap CT at the rated exhaust speed when beginning gas discharge, and the cryo-trap CT becomes a predetermined temperature. In addition, it is preferable that the vacuum pump P1 be driven in advance. In other words, before switching the main valve V to the open state after the preparation process ends, the controller 21 drives the vacuum pump P1 and the cryo-trap CT in advance so that the exhaust capability obtained when the main valve V is connected becomes the rated exhaust speed in a freeze-drying device. At this time, the controller 21 may maintain the control valve V1 at the open state, and sufficiently discharge gas from the cryo-chamber CP using the vacuum pump P1, and then drive the cryo-trap CT. This lowers the moisture amount adsorbed by the cryo-trap CT after the cryo-trap CT is activated. Thus, the discharging speed variation of the pump is minimized, and only a change amount of the conductance affects the rated exhaust speed. This ensures the repetition reproducibility of pressure transition.

The controller 21 determines whether the temperature of the liquid surface of the liquid M accommodated in the freeze-drying chamber 11 or a temperature of a corresponding point has reached the predetermined exhaust process initiation temperature during the execution of preparation process. If the controller 21 determines that the temperature of the liquid surface of the liquid M accommodated in the freeze-drying chamber 11 has reached the exhaust process initiation temperature (time point t1 in FIG. 2), the controller 21 switches the main valve V from the closed state to the open state, ends the preparation process, and starts the exhaust process of the freeze-drying chamber 11.

In addition, to shorten the processing time, it is preferable that the first temperature, which is the temperature of the holding surface, be set to a low temperature so as to quickly decrease the temperature of the liquid surface of the liquid M, and the first temperature may be set to, for example, −20° C. Nevertheless, in this case, preferably, the controller 21 switches the temperature of the holding surface to the second temperature at the same time as when starting depressurization of the freeze-drying chamber 11 so that ice nucleation is not generated during exhaust mitigation process because of excessive heat removal resulting from the setting of the temperature to a value lower than the first temperature. In this case, when time is required to switch the temperature because of a large heat capacity, the controller 21 advances the switching time for an amount corresponding to such a delay.

In the exhaust process of the freeze-drying chamber 11, the controller 21 first keeps the control valve V1 fully open and maintains the rated exhaust speed until the total pressure value of the freeze-drying chamber 11 reaches a zeroth target value. The zeroth target value is, for example, 20 kPa. Subsequently, if the pressure of the freeze-drying chamber 11 falls below the zeroth target value (time point t2 in FIG. 2), the controller 21 executes exhaust mitigation process until the pressure of the freeze-drying chamber 11 reaches the first target value. The controller 21 executes the exhaust mitigation process by executing a low-speed exhaust process to reduce the conductance value for discharging gas from the freeze-drying chamber 11 and further mitigate the state of a pressure transient response of the freeze-drying chamber 11 as compared with the state of the rated exhaust speed. Thus, the controller 21 exposes the liquid M to depressurization for a longer time than the rated exhaust speed, and removes a greater amount of dissolved gas from the liquid M than the rated exhaust speed. Then, by exhaust mitigation process, the controller 21 decreases the stochasticity at which bubble formation occurs in the liquid M during processing following the exhaust mitigation process, and efficiently advances cooling of only the liquid surface of the liquid M.

The controller 21 determines whether the pressure of the freeze-drying chamber 11 is less than the first target value, while executing low-speed exhaust process during the execution of exhaust mitigation process. Alternatively, the controller 21 may execute low-speed exhaust process in a period from time point t2 of FIG. 2 to the vicinity of time point t3, and the controller 21 may control the exhaust speed during the low-speed exhaust process so that the pressure of the freeze-drying chamber 11 reaches the first target value. The control of the exhaust speed in the low-speed exhaust process varies the exhaust speed, for example, lowers the exhaust speed. Regardless of whether the value decrease to less than the first target value is monitored or control is performed so that the value reaches the first target value, the controller 21 executes the low-speed exhaust process so as to shift to the pressure set in advance for the exhaust mitigation process. If the controller 21 determines that the pressure of the freeze-drying chamber 11 is less than the first target value (timing t3 of FIG. 2), the controller 21 executes the exhaust intensification process until the pressure of the freeze-drying chamber 11 reaches the second target value. The controller 21 performs the exhaust intensification process by executing the high-speed exhaust process. The state of a transient response in the pressure of the freeze-drying chamber 11 changes to an exhaust capability that is greater than or equal to the rated exhaust capability. With this configuration, before generation and growth of gas phase nucleus occur in the liquid M, an ice nucleus is generated in most of or all of the liquid surface of the liquid M.

The controller 21 determines whether the pressure of the freeze-drying chamber 11 is less than the second target value during the exhaust mitigation process. If the controller 21 determines that the pressure of the freeze-drying chamber 11 is less than the second target value (timing t4 of FIG. 2), the controller 21 executes the boiling hindrance process. This hinder gas phase nucleus generation and gas phase nucleus growth in the liquid M. and a stable liquid-solid equilibrium state can be formed in the container C. Alternatively, before the generation and growth of gas phase nucleus, a stable liquid-solid equilibrium can be formed in the container C. Then, after the freeze-drying device sublimates a frozen material of a medium generated through vacuum-induced surface freezing, the freeze-drying device fully-plugs the container C, and unloads the container C accommodating a freeze-dried material. In addition, when the boiling hindrance process is executed, specifically, after the pressure of the freeze-drying chamber 11 rises to a pressure greater than or equal to a triple point of the medium, the freeze-drying device may decrease the temperature of the holding surface. This cancels the inflow of latent heat caused by crystal growth, and crystal growth does not slow and the liquid-solid equilibrium state continues to be dominant in the container C. Thus, the crystal state of a product becomes uniform.

The above-described embodiment has the following advantages.

(1) The exhaust mitigation process discharges more dissolved gas from the liquid M than when the exhaust capability is the rated exhaust capability. Thus, the exhaust mitigation process is a preparation process that hinders the generation and growth of gas phase nucleus after the exhaust mitigation process. In addition, the exhaust mitigation process vaporizes the medium included in the liquid M from the liquid surface of the liquid M. and selectively cools the liquid surface of the liquid M in the liquid M so that the temperature at the liquid surface is the lowest in the liquid M. Then, the exhaust intensification process generates an ice nucleus in most of the liquid surface of the liquid M or in the entire container C so that crystals grow after the exhaust intensification process.

By using the pressure of the medium, that is, the partial pressure value of a medium for switching between the exhaust mitigation process and the exhaust intensification process, the occurrence of a bumping phenomenon can be hindered. This allows for precise and effective freezing of the liquid surface of the liquid M. Thus, variations are limited in the shape and characteristics of a dried material.

(2) In a case where the controller 21 increases the temperature of the holding surface in the exhaust mitigation process to a temperature higher than the first temperature set before the exhaust mitigation process so that excessive cooling does not occur during the exhaust mitigation process, the generation of an ice nucleus is easily hindered during exhaust mitigation process in part of the liquid M.

(3) In a case where the controller 21 increases the exhaust speed during the exhaust intensification process to be greater than the rated exhaust speed, pressure transition reflecting a higher exhaust speed occurs, which is in contrast to pressure transition at an exhaust speed less than or equal to the rated exhaust speed. This allows the generation stochasticity of an ice nucleus on the entire liquid surface of the liquid M to be advanced as compared with pressure transition occurs at the rated exhaust speed. In other words, the time exposed to an increased ice nucleation stochasticity is extended. Moreover, the time required to shift from the first target value to the second target value is shortened. Thus, even if the heat removal amount is the same, the processing can proceed to the next processing before the medium or the like in the liquid M causes a bumping phenomenon. Furthermore, a device similar to the device in FIG. 1 will be able to have gas discharged at an exhaust speed greater than or equal to the rated exhaust speed by changing the control method of an exhaust system. Thus, the method can easily be applied to a conventional device and has high industrial applicability.

The above-described embodiment may be modified as described below.

The edges of the liquid surface in the container C is raised over a distance of approximately 1 mm from the liquid surface. This indicates that the ice nucleation generation stochasticity at the edge of the liquid surface was relatively increased during the exhaust intensification process. Thus, by performing a hydrophilic treatment on an inner surface of the container C or vibrating the container C to decreasing the contact angle, ice nucleation may be accelerated on the entire liquid surface.

The controller 21 may open the vent valve V0 and draw ice fog into the freeze-drying chamber 11 to perform the boiling hindrance process. For example, the freeze-drying device includes a frost formation unit on a path extending from the vent valve V0 into the freeze-drying chamber 11, and the controller 21 opens the vent valve V0, separates frost from the frost formation unit with the gas speed energy when pressure recovery is performed, and draws ice fog into the freeze-drying chamber 11. In this case, for example, even when the second target value cannot be sufficiently decreased due to the high viscosity of the liquid M, that is, even when the stochasticity in which all of the liquids M are frozen decreases, the stochasticity in which the liquids M are all frozen can be increased by having ice fog enter the liquid M.

The freeze-drying device may include a low temperature surface that decreases the temperature of air drawn from the vent valve V0, and the controller 21 may recover the pressure of the freeze-drying chamber 11 using air having a lower temperature than room temperature. The low temperature of air drawn into the freeze-drying chamber 11 decreases stochasticity in which the generated crystal and grown crystal are dissolved. In addition, pressure recovery may be performed by drawing in low-temperature gas. For example, low-temperature gas such as nitrogen may be drawn into the freeze-drying chamber 11 through the vent valve V0 from the inside of a container of liquid nitrogen at 0.2 MPa or greater. A method of recovering pressure by drawing in low-temperature gas may be executed when ice fog is drawn in as described above. This obtains a synergetic obtained by ice fog and the drawn in low-temperature gas.

The controller 21 may decrease the temperature of the holding surface in the exhaust intensification process. An unstable nucleus of the medium dissolved in the boiling hindrance process becomes a stable ice nucleus that can grow into a crystal by promptly decreasing the temperature around the liquid M to an extent that a solid phase becomes dominant among three forms of the medium. Such an unstable nucleus is easily generated when, for example, the volume of the solid phase is much smaller than the volume of the liquid phase or when a crystal growth is very slow. When the temperature of the holding surface is decreased so that the solid phase becomes dominant among three forms of the medium, in the boiling hindrance process, crystal growth can be accelerated. This increases the freezing stochasticity in all of the liquids M and shortens the time until freezing. For example, the controller 21 may decrease the temperature of the holding surface to −40° C. in the exhaust intensification process.

CLAUSES

The present disclosure encompasses the embodiments described below.

1. A freeze-drying device including.

a controller configured to control depressurization of containers filled with a liquid including a raw material and a medium to freeze the liquid from a liquid surface, wherein the controller executes an exhaust mitigation process that performs the depressurization at an exhaust capability that is less than a rated exhaust capability of the freeze-drying device, and the controller uses a partial pressure value of the medium to determine when the exhaust mitigation process ends.

2. The freeze-drying device according to clause 1, wherein the controller sets an exhaust speed of the freeze-drying device to be greater than a rated exhaust speed of the freeze-drying device after the exhaust mitigation process.

3. The freeze-drying device according to clause 1 or 2, further including:

a gas capture pump configured to exhaust a freeze-drying chamber accommodating the containers; and a positive-displacement pump configured to discharge gas from a space accommodating the gas capture pump, wherein the controller maintains an exhaust speed of the gas capture pump and decreases an exhaust speed of the positive-displacement pump in the exhaust mitigation process.

4. The freeze-drying device according to any one of clauses 1 to 3, wherein the controller sets an exhaust speed of the freeze-drying device to a rated exhaust speed of the freeze-drying device or larger before the exhaust mitigation process.

5. The freeze-drying device according to any one of clauses 1 to 4, wherein the controller executes an exhaust intensification process after the exhaust mitigation process and uses a partial pressure value of the medium to determine when the exhaust intensification process ends.

6. The freeze-drying device according to clause 5, wherein the controller executes a boiling hindrance process after the exhaust intensification process and uses low-temperature gas or ice fog when recovering pressure during the boiling hindrance process.

7. The freeze-drying device according to any one of clauses 1 to 6, wherein the controller changes a temperature of a holding surface on which the containers are held in the exhaust mitigation process.

8. The freeze-drying device according to clause 7, wherein the controller sets the temperature of the holding surface in the exhaust mitigation process to be higher than that before the exhaust mitigation process.

9. A freeze-drying method including:

depressurizing containers filled with a liquid including a raw material and a medium with a freeze-drying device to freeze the liquid from a liquid surface, wherein:

the depressurizing includes executing an exhaust mitigation process that performs the depressurizing at an exhaust capability that is less than a rated exhaust capability of the freeze-drying device, and using a partial pressure value of the medium to determine when the exhaust mitigation process ends.

10. The freeze-drying method according to clause 9, wherein the depressurizing includes setting an exhaust speed of the freeze-drying device to be greater than a rated exhaust speed of the freeze-drying device after the exhaust mitigation process.

11. The freeze-drying method according to clause 9 or 10, wherein the executing an exhaust mitigation process includes maintaining an exhaust speed of a gas capture pump configured to discharge gas from a freeze-drying chamber accommodating the containers, and decreasing an exhaust speed of a positive-displacement pump configured to discharge gas from a space accommodating the gas capture pump.

12. The freeze-drying method according to any one of clauses 9 to 11, wherein the depressurizing includes setting an exhaust speed of the freeze-drying device to a rated exhaust speed of the freeze-drying device or greater before the exhaust mitigation process.

13. The freeze-drying method according to any one of clauses 9 to 12, wherein the depressurizing includes executing an exhaust intensification process after the exhaust mitigation process, and using a partial pressure value of the medium to determine when the exhaust intensification process ends.

14. The freeze-drying method according to clause 13, further including executing a boiling hindrance process after the exhaust intensification process, wherein low-temperature gas or ice fog is used when recovering pressure during the boiling hindrance process.

15. The freeze-drying method according to any one of clauses 9 to 14, wherein the executing the exhaust mitigation process includes changing a temperature of a holding surface on which the containers are held.

16. The freeze-drying method according to clause 15, wherein the executing the exhaust mitigation process includes setting the temperature of the holding surface in the exhaust mitigation process to be higher than before the exhaust mitigation process.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

The invention claimed is:

1. A freeze-drying device comprising:

a controller configured to control depressurization of containers filled with a liquid including a raw material and a medium to freeze the liquid from a liquid surface, a gas capture pump configured to exhaust a freeze-drying chamber accommodating the containers; and a positive-displacement pump configured to discharge gas from a space accommodating the gas capture pump, wherein the controller executes an exhaust mitigation process that performs the depressurization at an exhaust capability that is less than a rated exhaust capability of the freeze-drying device, and the controller uses a partial pressure value of the medium to determine when the exhaust mitigation process ends; and wherein the controller maintains an exhaust speed of the gas capture pump and decreases an exhaust speed of the positive-displacement pump in the exhaust mitigation process.

2. The freeze-drying device according to claim 1, wherein the controller sets an exhaust speed of the freeze-drying device to be greater than a rated exhaust speed of the freeze-drying device after the exhaust mitigation process.

3. The freeze-drying device according to claim 1, wherein the controller sets an exhaust speed of the freeze-drying device to a rated exhaust speed of the freeze-drying device or larger before the exhaust mitigation process.

4. The freeze-drying device according to claim 1, wherein the controller executes an exhaust intensification process after the exhaust mitigation process and uses a partial pressure value of the medium to determine when the exhaust intensification process ends.

5. The freeze-drying device according to claim 4, wherein the controller executes a boiling hindrance process after the exhaust intensification process and uses low-temperature gas or ice fog when recovering pressure during the boiling hindrance process.

6. The freeze-drying device according to claim 1, wherein the controller changes a temperature of a holding surface on which the containers are held in the exhaust mitigation process.

7. The freeze-drying device according to claim 6, wherein the controller sets the temperature of the holding surface in the exhaust mitigation process to be higher than that before the exhaust mitigation process.

8. A freeze-drying device comprising:

a controller configured to control depressurization of containers filled with a liquid including a raw material and a medium to freeze tare liquid from a liquid surface, wherein the controller executes an exhaust mitigation process that performs the depressurization at an exhaust capability that is less than a rated exhaust capability of the freeze-drying device, and the controller uses a partial pressure value of the medium to determine when the exhaust mitigation process ends; and wherein the controller sets an exhaust speed of the freeze-drying device to a rated exhaust speed of the freeze-drying device or larger before the exhaust mitigation process.

* * * * *